United States Patent [19]

Topping

[11] Patent Number: 4,553,522

[45] Date of Patent: Nov. 19, 1985

[54] MOUNTING MEANS FOR BOW STABILIZERS

[76] Inventor: Donald G. Topping, 886 Woodbine Dr., Crestwood, Mo. 63126

[21] Appl. No.: 538,214

[22] Filed: Oct. 3, 1983

[51] Int. Cl.[4] ..... F41B 5/00

[52] U.S. Cl. ..... 124/89

[58] Field of Search ..... 124/23 R, 24 R, 89

[56] References Cited

U.S. PATENT DOCUMENTS

| | | | |
|---|---|---|---|
| 3,412,725 | 11/1968 | Hoyt | 124/89 X |
| 3,752,142 | 8/1973 | Morita et al. | 124/89 X |
| 3,804,072 | 4/1974 | Izuta | 124/89 X |
| 4,054,121 | 10/1977 | Hoyt | 124/89 |

*Primary Examiner*—Richard J. Apley
*Assistant Examiner*—William R. Browne
*Attorney, Agent, or Firm*—Charles E. Markham

[57] ABSTRACT

A device for resiliently mounting a pair of stabilizer rods for universal angular adjustment on a bow has a central member fixed to the bow and having a cylindrical portion projecting from each end, a pair of intermediate members each has a bore in one end receiving a cylindrical portion for rotation thereon and an axial slot bifercating it's other end, and a pair of outer end members each having a flat sided portion projecting from one end entering a slot and rotatable on a screw passing transversely through the bifercated end portions and the flat sided projection and threadedly engaged in one bifercated portion so as to prevent rotation when tightened; each of the outer end members having means at the other end for attachment of a stabilizer rod. An axial slit in the walls defining each bore causes the walls of the bore to grip the cylindrical portion therein to also prevent axial rotation of the intermediate member when the screw is tightened and a resilient member operatively connecting the flat sided projecting portions and the stabilizer rod attaching means.

3 Claims, 12 Drawing Figures

MOUNTING MEANS FOR BOW STABILIZERS

This invention relates to means for mounting a pair of stabilizers, one on each side of a bow for universal angular adjustment and particularly concerns a novel and improved unitary structure wherein the stabilizers are resiliently connected to the bow and are universally adjustable.

BACKGROUND OF THE INVENTION

A pair of stabilizers each consisting of a rod with a weighting element at one end are attached at their other ends to opposite sides of a bow via a mounting structure which provides individual universal angular adjustment of the stabilizer rods. This arrangement permits inter alia the static balancing of the bow in the individual archer's grip under shooting conditions. Mounting structures have been provided and are presently in use which provide for this separate universal angular adjustment of the stabilizer rods. Also, a separate device has been provided and is presently in use for attachment between the bow and the unweighted ends of stabilizer rods for resiliently connecting the rods to the bow so as to absorb shock under shooting conditions.

Universal angular adjustment of a stabilizer rod implies angular adjustment of the rod around two perpendicular axes and it has been customary heretofore to provide separate means for fixing the stabilizer rod in or releasing it from an adjusted position around each of the two axes. It has also been the practice heretofore to provide a separate structure for connection between the unweighted ends of the stabilizer rods and the mounting means for resiliently connecting the stabilizers to the bow.

Applicant has invented a unique unitary mounting structure which, when fixed to a bow, resiliently mounts the stabilizers on the bow, provides for the convenient universal angular adjustment of the stabilizer rods and provides a single screw means for sequentially fixing or releasing an angular adjustment of a stabilizer rod about it's two axes.

OBJECTS OF THE INVENTION

It is an object of this invention to provide a generally new and improved unitary structure for the resilient and universally adjustable mounting of a pair of stabilizers on a bow.

A further object is to provide a single screw means which, when tightened or loosened, sequentially fixes or releases a universal angular adjustment of a stabilizer rod about two axes.

A further object is to provide a conveniently adjustable resilient connection of a stabilizer rod to a bow.

These and other objects and advantages will become apparent when reading the following description of a preferred form of the invention in connection with the accompanying drawing.

IN THE DRAWING

FIG. 5, is one end elevational view of the mounting device shown in FIG. 3, both ends are similar;

DESCRIPTION OF A PREFERED FORM OF THE INVENTION

Figure 3:
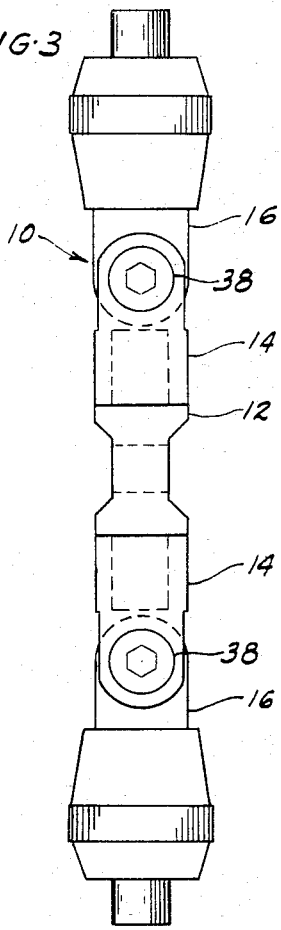
FIG. 3, is an enlarged side elevational view of the mounting device.
Figure 4:
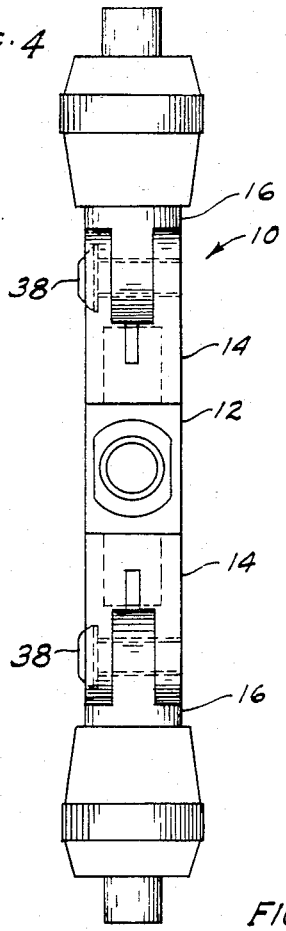
FIG. 4, is a side elevational view of the mounting device rotated 90° from the view shown in FIG. 3.

Refering to the drawing in more detail, a mounting device consisting of five pivotally connected sections and generally indicated at 10 comprises a single central section 12, a pair of intermediate sections 14 and a pair of outer end sections 16, see FIGS. 3 and 4. The central section 12 is cylindrical and has a central transverse aperture 18 therethrough and a surrounding pair of opposed, round bottomed recesses 20. One of the recesses 20 receives the head of a ferrule 22 which is conventionally fixed in the handle section of a bow 24 shown fragmentarily in FIGS. 1 and 2 of the drawing. The other recess 20 receives the head of an attaching screw 26 which passes through aperture 18 and is screw threadedly engaged in the ferrule 22 thereby to fix the central section 12 of the mounting means 10 to the handle section of the bow 24 in a horizontal position, see FIG. 2.

Figure 10:
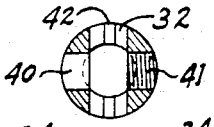
Figure 9:
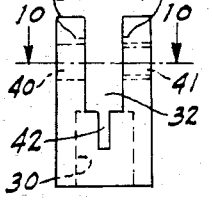
FIG. 9, is a side elevational view of the intermediate section shown in FIG. 8, rotated 90° from FIG. 8, FIG. 10, is a transverse cross sectional view looking along line 10—10 of FIG. 9.
Figure 11:
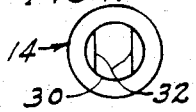
FIG. 11, is an end elevational view of the intermediate section shown in FIG. 9.

The central section 12 is further provided with a reduced diameter cylindrical portion 28 projecting from each end. The reduced diameter cylindrical portions 28 enter longitudinal bores 30 in one end of each of the intermediate sections 14 in fitting relationship. The intermediate sections 14 are thereby rotatable on the longitudinal axis of the central section 12 at each end thereof. The intermediate sections 14, which are cylindrical, each have a longitudinal slot 32 therein extending axially inward from it's other end thereby to bifurcate the other ends of the intermediate sections 14 and to provide a pair of transversely spaced, elongated portions 34 with adjacent flat side see FIGS. 9 to 11. The spaced, elongated portions 34 receive therebetween flat sided elongated portions 36 projecting longitudinally from one end of each of the outer end sections 16. A cap screw 38 passes through aligned apertures 40 and 41 passing transversly through spaced portions 34 of sections 14 and through aperture 43 in the flat portion 36 perpendicular to the longitudinal axes of sections 12 and 14. The outer end sections 16 of the mount rotate around the axis of cap screws 38 perpendicular to the longitudinal axis around which intermediate sections 14 rotate.

The transverse apertures 41 in the portions 34 are screw threaded for engagement of cap screws 38 while apertures 40 are clearance holes. Tightening of cap screws 38 fix the rotation of outer end sections 16 on the axis of screws 38. Additionally, longitudinal slits 42 are provided in opposite walls of the intermediate sections 14 in the same plane as slots 32. The slits 42 extend longitudinally from the bottoms of slots 32 to well into the bores 30 whereby the round projections 28 entered into bores 30 are pinched so as to prevent their rotation when cap screws 38 are tightened.

A salient feature of the invention is the locking against adjustment or the releasing from a locked adjustment of an outer end section 16 of both longitudinal and transverse axes by a single screw and in a definate sequence as the screw is tightened or loosened. The free fit of the projecting round ends 28 of the central section 12 in the bores 30 of the intermediate sections 14 and the extension of the slits 42 into the bores 30 are made such as compared to the free fit of the flat portions 36 of the outer end portions 16 in the slots 32 that the projecting round ends 28 are first gripped sufficiently tight as screws 38 are tightened to lock the intermediate sections 14 against rotation on the axis of cylindrical portions 28 first and to then lock the outer end sections 16 against rotation on a transverse axis last as the screws are further tightened. Also, as the screws 38 are loosened, the outer end sections 16 are free to rotate first and the intermediate sections last. The parameters effecting this sequence are made such that manipulation of the screws is not sensitive.

Figure 6:
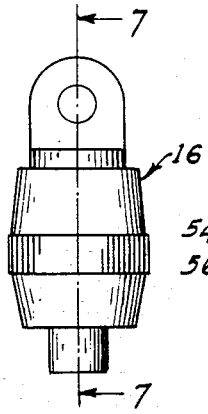
FIG. 6 is a side elevational view of one of the outer end sections of the mounting device and is shown alone.
Figure 7:
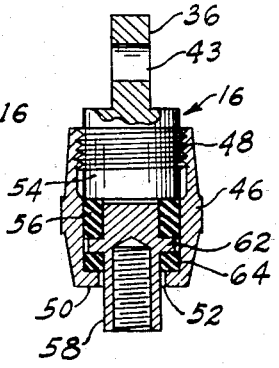
FIG. 7, is a longitudinal cross sectional view of the outer end section shown in FIG. 6, looking along line 7—7 of FIG. 6.
Figure 12:
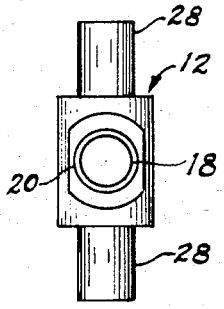
FIG. 12 is a side elevational view of the single central section of the mounting device.
Figure 8:
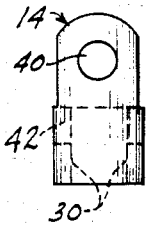
FIG. 8, is a side elevational view of one of the intermediate sections of the mounting device shown alone.

The outer end sections 16, see FIGS. 6 and 7, each comprise a generally cylindrical hollow shell 46 having internal screw threads 48 at one end and having a closing wall 50 at it's other end with a central perforation 52 therein. Within the shell 46 is a cylindrical exteriorly, screw threaded member 54 in threaded engagement with the shell internal screw threads 48 and having the before mentioned flat portions 36 formed integrally on one end thereof and projecting exteriorly from the one end of the shell 46. The other end of cylindrical member 54 bears against one face of a rubber annulus 56 within the shell 46. A second cylindrical member 58 of smaller diameter in axial alignment with member 54 and slightly spaced longitudinally therefrom has a portion of it's length within shell 46 and a portion projecting exteriorly from the other end thereof through aperture 52 in wall 50.

Figure 5:
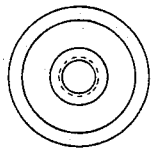
Figure 1:
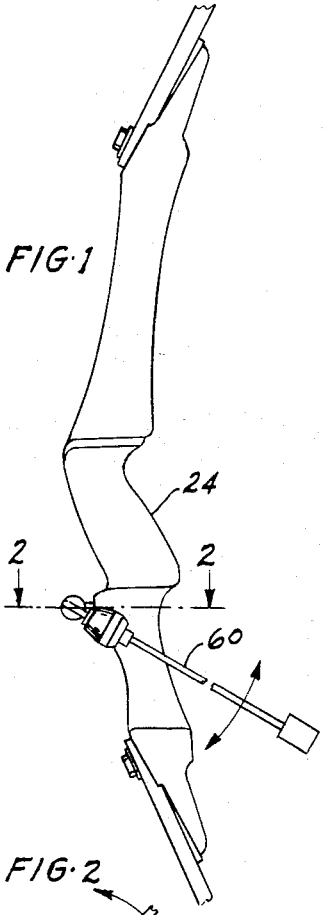
FIG. 1, is a fragmentary side elevational view of a bow showing a stabilizer mounting device constructed in accordance with the present invention connecting a pair of stabilizers to the bow.
Figure 2:
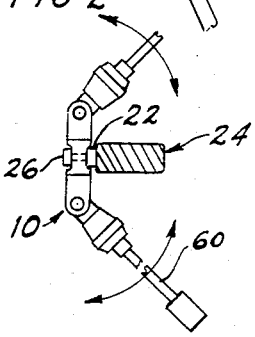
FIG. 2, is a cross sectional view looking along line 2—2 of FIG. 1.

The exteriorly projecting end portion of member 58 has an axial screw threaded bore therein for receiving in screw threaded engagement the screw threaded end of a stabilizer rod 60, see FIGS. 1 and 2. The internal portion of member 58 has a collar 62 thereon. One side of collar 62 bears against the opposite face of rubber annulus 56 and the other side bears against a thin rubber washer 64 which lies between collar 62 and the end wall 50. The outer surface of shell 46 has a knurled portion 66 thereon to facilitate thumb and finger rotation thereof. It will be seen that as shell 46 is rotated in one direction with respect to member 54 that gyration of the projecting end of member 58 and the stabilizer rod 60 connected thereto will be less for a given shock of the bow and as the shell is rotated oppositely the amplitude of these gyrations will increase, thereby providing a conveniently adjustable resilient mounting of the stabilizers on the bow.

From the foregoing it will be seen that I have provided a novel and unique unitary structure for resiliently mounting a pair of stabilizers on opposite sides of a bow for convenient universal angular adjustment of the stabilizer rods. Also, that I have provided in this unitary structure a single screw means for the definate sequential locking or releasing of the angular adjustment of each stabilizer rod around two perpendicular axes and have provided a means therein for conveniently adjusting the resilience of the connection of stabilizer rods thereto.

I claim:

1. A device for mounting a pair of stabilizers on a bow for universal adjustment of their angular projection from opposite sides of a bow comprising:

a central, elongated section (12) having an intermediate portion arranged for the transverse, fixed attachment to a bow, said central section (12) also being provided with a cylindrical portion (28) extending axially outward from each end, a pair of elongated intermediate sections (14) each having a bore (30) extending axially inward from one end and each fittingly receiving therein one of said cylindrical portions (28) for rotation thereon about a first axis, said pair of intermediate sections (14) each having a slot (32) extending axially inward from its other end thereby to bifurcate said other end and to provide two spaced portions (34) with adjacent flat surfaces, said pair of intermediate sections (14) each being further provided with a slit (42) extending axially from the bottom of said slot (32) into said bore (30) thereby to provide resiliency, a pair of elongated end sections (16) each having a flat sided portion (36) extending axially outward from one end and fittingly inserted between said spaced portions (34) of one of said pair of intermediate sections (14), and each of said pair of end sections (16) having a screw threaded bore extending axially inward from its other end for the screw threaded attachment thereto of one end of a stabilizer (60), aligned aperatures (40), (41) and (43) extending through said spaced portions (34) and said flat sided portion (36) of each of said sections (14) and (16) are provided, and a single screw (38) extending through said aligned apertures in said portions (34) and (36) of each of said sections (14) and (16) provides a second, perpendicular axis of rotation for each end section (16) relative to each intermediate section (14) when loosened, and when tightened sufficiently screw (38) clamps a cylindrical portion (28) of central section (12) in a bore (30) of intermediate section (14) and clamps said flat sided portion (36) of end section (16) between spaced portions (34) of intermediate section (14) to provide a locked universal adjustment of each stabilizer.

2. A device as claimed in claim 1 in which said pairs of end section (16) each comprise two members (54) and (58), in which said flat sided portions (36) are portions of said members (54) and in which said screw threaded bores for attaching one end of stabilizers are formed in said members (58), and in which said members (54) and (58) are resiliently connected.

3. A device as claimed in claim 1 in which the free fit of said cylindrical portions (28) in said bores (30) relative to the free fit of said flat sided portions (36) between said spaced portions (34) is such that as said screws (38) are initially tightened rotational adjustment of said intermediate sections (14) on said cylindrical projecting ends of sections (12) will become securely locked while said end sections (16) may be freely rotationally adjusted on screws (38) relative to intermediate sections (14) and when screws (38) are further tightened rotational adjustment of end sections (16) relative to intermediate sections (14) will also become securely locked.

* * * * *